US008481841B2

(12) United States Patent
Shimoda

(10) Patent No.: US 8,481,841 B2
(45) Date of Patent: Jul. 9, 2013

(54) MUSICAL TONE CONTROL SYSTEM FOR ELECTRONIC KEYBOARD INSTRUMENT

(75) Inventor: Yoshiaki Shimoda, Hamamatsu (JP)

(73) Assignee: Kabushiki Kaisha Kawai Gakki Seisakusho, Shizuoka (JP)

( * ) Notice: Subject to any disclaimer, the term of this patent is extended or adjusted under 35 U.S.C. 154(b) by 12 days.

(21) Appl. No.: 13/128,614

(22) PCT Filed: Nov. 13, 2009

(86) PCT No.: PCT/JP2009/069388

§ 371 (c)(1),
(2), (4) Date: May 10, 2011

(87) PCT Pub. No.: WO2010/055921

PCT Pub. Date: May 20, 2010

(65) Prior Publication Data

US 2011/0239846 A1 Oct. 6, 2011

(30) Foreign Application Priority Data

Nov. 17, 2008 (JP) ..... 2008-293110

(51) Int. Cl.
*G10H 1/32* (2006.01)

(52) U.S. Cl.
USPC ..... 84/744; 84/719; 84/723; 84/737

(58) Field of Classification Search
USPC ..... 84/626, 658, 687, 719, 723, 724, 84/726, 733, 734, 744
See application file for complete search history.

(56) References Cited

U.S. PATENT DOCUMENTS

| | | | | |
|---|---|---|---|---|
| 4,593,592 | A * | 6/1986 | Stahnke | 84/21 |
| 5,619,005 | A * | 4/1997 | Shibukawa et al. | 84/658 |
| 5,679,914 | A * | 10/1997 | Niitsuma | 84/687 |
| 7,361,825 | B2 * | 4/2008 | Nishida | 84/626 |
| 2007/0131099 | A1 * | 6/2007 | Nishida et al. | 84/658 |
| 2008/0307944 | A1 * | 12/2008 | Watanabe | 84/433 |

FOREIGN PATENT DOCUMENTS

| | | |
|---|---|---|
| JP | 6- 318077 | 11/1994 |
| JP | 9-120287 | 5/1997 |

(Continued)

OTHER PUBLICATIONS

International Search Report, dated Dec. 22, 2009, corresponding to PCT/JP2009/069388.

*Primary Examiner* — Marlon Fletcher
(74) *Attorney, Agent, or Firm* — Christie, Parker & Hale, LLP.

(57) ABSTRACT

A musical tone control system for an electronic keyboard instrument, which is capable of calculating a key depression velocity of a key with high accuracy without being adversely affected by a large rotational resistance of the key during a let-off, and stopping sounding of a musical tone in appropriate timing. The system detects first key depression information on a key at a first position corresponding to a key depression depth obtained before start of a let-off, second key depression information on the key at a second position which corresponds to a larger key depression depth than the first position does, and third key depression information, obtained after termination of the let-off, on the key at a third position which corresponds to a larger key depression depth than the second position does. The tone volume of a musical tone is set based on a key depression velocity of the key.

1 Claim, 10 Drawing Sheets

FOREIGN PATENT DOCUMENTS

| | | |
|---|---|---|
| JP | 9-120288 | 5/1997 |
| JP | 2932132 | 5/1999 |
| JP | 2002-162969 | 6/2002 |
| JP | 2007-52357 | 3/2007 |

* cited by examiner (a)

(b)

(c)

MUSICAL TONE CONTROL SYSTEM FOR ELECTRONIC KEYBOARD INSTRUMENT

CROSS-REFERENCE TO RELATED APPLICATION(S)

This application is a National Phase Patent Application and claims the priority of International Application Number PCT/JP2009/069388, filed on Nov. 13, 2009, which claims priority of Japanese Patent Application Number 2008-293110, filed on Nov. 17, 2008.

TECHNICAL FIELD

The present invention relates to a musical tone control system for an electronic keyboard instrument having a let-off mechanism for imparting a let-off effect in accordance with key depression.

BACKGROUND ART

In an acoustic piano, such as a grand piano, an action operates in accordance with depression of an associated key, to cause pivotal motion of an associated hammer, and the pivotally moved hammer strikes a string to thereby generate a piano tone. Further, in the acoustic piano, the jack of the action is configured to be released from the hammer before the hammer strikes the string. Before and after the release of the jack from the hammer, the touch weight of the key is increased and then sharply reduced, whereby a so-called let-off effect is obtained. The let-off effect is peculiar to an acoustic piano, and therefore in a keyboard instrument, such as an electronic piano, as well, it is preferable to obtain the let-off effect so as to make the touch feeling of the electronic piano analogous to that of an acoustic piano.

As an electronic piano having a let-off mechanism for imparting the above-mentioned let-off effect, there has been known one disclosed e.g. in Patent Literature 1. The let-off mechanism comprises a protruding member protruding from the lower surface of a key and an elastic member attached to a chassis. In the electronic piano, the protruding member is brought into temporary engagement with the elastic member by key depression, whereby the let-off effect is obtained. Further, on the chassis, there are disposed a first switch and a second switch in a manner opposed to the key. Each of the first and second switches is in the OFF state in a key-released state, and when the key pivotally moving in accordance with key depression reaches a first predetermined position P11 and a second predetermined position P12, the first and second switches are sequentially turned on, respectively, in the mentioned order. As shown in FIG. 12, the first predetermined position P11 corresponds to a key depression depth of the key in a final stage of a let-off, and the second predetermined position P12 corresponds to a key depression depth of the key around termination of the let-off. Further, in the musical tone control system, the tone volume of a musical tone to be output is set based on a key depression velocity calculated based on a time period from the turn-on of the first switch to the turn-on of the second switch, and sounding timing for sounding the musical tone is set based on timing in which the second switch is turned on.

However, in the conventional musical tone control system, each of the first and second switches is configured to detect the key-depressed state of the key after the final stage of the let-off, and therefore if sounding stop timing is set based on timing in which the first or second switch is switched from ON to OFF, sounding of a musical tone is stopped in too early timing, e.g. immediately after the key starts return motion, which causes odd feeling in performance.

Further, as another musical tone control system for an electronic piano having the let-off mechanism, there has been known one disclosed e.g. in Patent Literature 2. This electronic piano has a first switch and a second switch disposed in a manner opposed to an associated hammer. Each of the first and second switches is in the OFF state in a key-released state, and when an associated key pivotally moving in accordance with key depression reaches a first predetermined position P11' and a second predetermined position P12', the first and second switches are turned on, respectively. As shown in FIG. 13, the first predetermined position P11' corresponds to a key depression depth obtained immediately after start of a let-off, and the second predetermined position P12' corresponds to a key depression depth obtained immediately before the termination of the let-off. In this musical tone control system, a musical tone is controlled based on a key depression velocity calculated based on a time period from the turn-on of the first switch to the turn-on of the second switch.

As described above, in the conventional musical tone control system, the first switch and the second switch are configured to detect the key-depressed state of the key immediately after the start of the let-off and immediately before the termination of the same, respectively, i.e. both during occurrence of the let-off. However, during occurrence of the let-off, the motion of the key becomes unstable due to an increase in the rotational resistance of the key, and hence the time period from the turn-on of the first switch to the turn-on of the second switch can easily vary, which causes degradation of accuracy of calculation of the key depression velocity based on the time period. This problem becomes conspicuous particularly when a key depressing force is small, because the time period of occurrence of the let-off becomes longer and hence variation in the time period between the turn-on of the first switch and the turn-on of the second switch is liable to become larger.

The present invention has been made in order to solve the above problem, and an object thereof is to provide a musical tone control system for an electronic keyboard instrument, which is capable of calculating a key depression velocity of a key with high accuracy without being adversely affected by a large rotational resistance of the key during a let-off, and stopping sounding of a musical tone in appropriate timing.

CITATION LIST

Patent Literature

Japanese Patent Publication No. 2932132

Japanese Laid-Open Patent Publication (Kokai) No. H06-318077

SUMMARY OF INVENTION

Solution To Problem

To attain the above object, the invention as claimed in claim 1 is a musical tone control system for an electronic keyboard instrument having a let-off mechanism for imparting a let-off effect in accordance with depression of a key, comprising first key depression information-detecting means for detecting key depression information on the key at a first position which corresponds to a key depression depth obtained before start of a let-off by the let-off mechanism, as a first key depression information item, second key depression information-detecting means for detecting key depression information on the key at a second position which corresponds to a larger key depression depth than the first position does and is obtained around start or termination of the let-off, as a second key depression information item, third key depression information-detecting means for detecting key depression information on the key at a third position which corresponds to a larger key depression depth than the second position does and is obtained after the termination of the let-off, as a third key depression information item, key depression velocity-calculating means for calculating a key depression velocity of the key based on two key depression information items corresponding to respective two key depression depths, between which the let-off does not occur, out of the detected first and second key depression information items and the detected second and third key depression information items, tone volume-setting means for setting tone volume of a musical tone, based on the calculated key depression velocity of the key, sounding timing-setting means for setting sounding timing for sounding the musical tone based on the third key depression information item, and sounding stop timing-setting means for setting sounding stop timing for stopping sounding of the musical tone based on the first or second key depression information item which corresponds to a key depression depth obtained before a time point around the start of the let-off.

According to this electronic keyboard instrument, when the key is depressed, the let-off effect is imparted by the let-off mechanism. Further, according to the musical tone control system, the first to third key depression information items are detected by the respective first to third key depression information-detecting means. The first key depression information item is associated with the first position which corresponds to a key depression depth obtained before the start of a let-off, and the second key depression information item is associated with the second position which corresponds to a larger key depression depth than the first position does and is obtained around the start or termination of the let-off. Further, the third key depression information item is associated with the third position which corresponds to a larger key depression depth than the second position does and is obtained after the termination of the let-off. The key depression velocity of the key is calculated based on two key depression information items corresponding to respective two key depression depths, between which the let-off does not occur, i.e. the first and second key depression information items or the second and third key depression information items. This makes it possible to accurately calculate the key depression velocity using the two key depression information items detected when the motion of the key is stable in a range of key depression depth within which the let-off with a large rotational resistance does not occur. Further, since the tone volume of a musical tone is set based on the thus detected key depression velocity, it is possible to obtain a tone volume suited to a key depressing force.

Further, sounding timing is set based on the third key depression information item corresponding to the key depression depth obtained after the termination of the let-off, so that a musical tone can be sounded in appropriate timing closest to string striking timing, similarly to an acoustic piano.

What is more, sounding stop timing is set based on the first or second key depression information item which corresponds to a key depression depth obtained before a time point around the start of the let-off, which makes it possible to stop musical tone sounding in appropriate timing. As described above, it is possible to calculate a key depression velocity of a key with high accuracy without being adversely affected by a large rotational resistance of the key during a let-off, and stop sounding of a musical tone in appropriate timing.

The invention as claimed in claim 2 is a musical tone control system wherein the second position corresponds to a key depression depth around the termination of the let-off, the key depression velocity-calculating means calculates the key depression velocity of the key based on the second and third key depression information items, and the sounding stop timing-setting means sets the sounding stop timing based on the first key depression information item.

According to this construction, since the second position corresponds to a key depression depth around the termination of the let-off, the let-off does not occur between the second position and the third position. Therefore, by using the second and third key depression information items corresponding to the respective second and third positions, it is possible to calculate the key depression velocity of the key with high accuracy without being adversely affected by a large rotational resistance of the key during the let-off. Further, since sounding stop timing is set based on the first key depression information item detected at the first position closest to key release timing, it is possible to stop musical tone sounding in appropriate timing.

The invention as claimed in claim 3 is a musical tone control system as claimed in claim 1, wherein the second position corresponds to a key depression depth around the start of the let-off, the key depression velocity-calculating means calculates the key depression velocity of the key based on the first and second key depression information items, and the sounding stop timing-setting means sets the sounding stop timing based on one of the first and second key depression information items.

According to this construction, since the second position corresponds to a key depression depth around the start of the let-off, the let-off does not occur between the first position and the second position. Therefore, by calculating the key depression velocity based on the first and second key depression information items, it is possible to calculate the key depression velocity of the key with high accuracy without being adversely affected by a large rotational resistance of the key during the let-off. Further, since sounding stop timing is set based on the first or second key depression information item detected at the first or second position close to key release timing, it is possible to stop musical tone sounding in appropriate timing.

The invention as claimed in claim 4 is a musical tone control system wherein the key depression velocity-calculating means includes key depression velocity-correcting means for correcting the key depression velocity calculated based on the first and second key depression information items, according to the first and third key depression information items or the second and third key depression information items.

For performance expression by a keyboard instrument, a player sometimes intentionally stops key depression temporarily immediately before the start of a let-off and then resumes the key depression. In this case, the key depression velocity is different between before and after the stoppage of the key depression. According to the present invention, the key depression velocity calculated based on the first and second key depression information items detected at the first position and the second position corresponding to respective key depression depths obtained before the start of the let-off is corrected according to the first or second key depression information item and the third key depression information item detected at the third position after the termination of the let-off. Therefore, it is possible to obtain a key depression velocity and a musical tone volume matching the above-mentioned playing method.

A view showing general construction of an electronic piano according to an embodiment of the present invention.

[FIG. 2]

An exploded perspective view of a let-off mechanism.

[FIG. 3]

A view of an example of operation of the electronic piano.

[FIG. 4]

A view showing part of a musical tone control system.

[FIG. 5]

A cross-sectional view of a key switch.

[FIG. 6]

A diagram showing the relationship between ON/OFF timings of first to third switches with respect to the key depression depth of a key in the first embodiment.

[FIG. 7]

A timing diagram of first to third detection signals output in accordance with pivotal motion of the key.

[FIG. 8]

Figure 4:
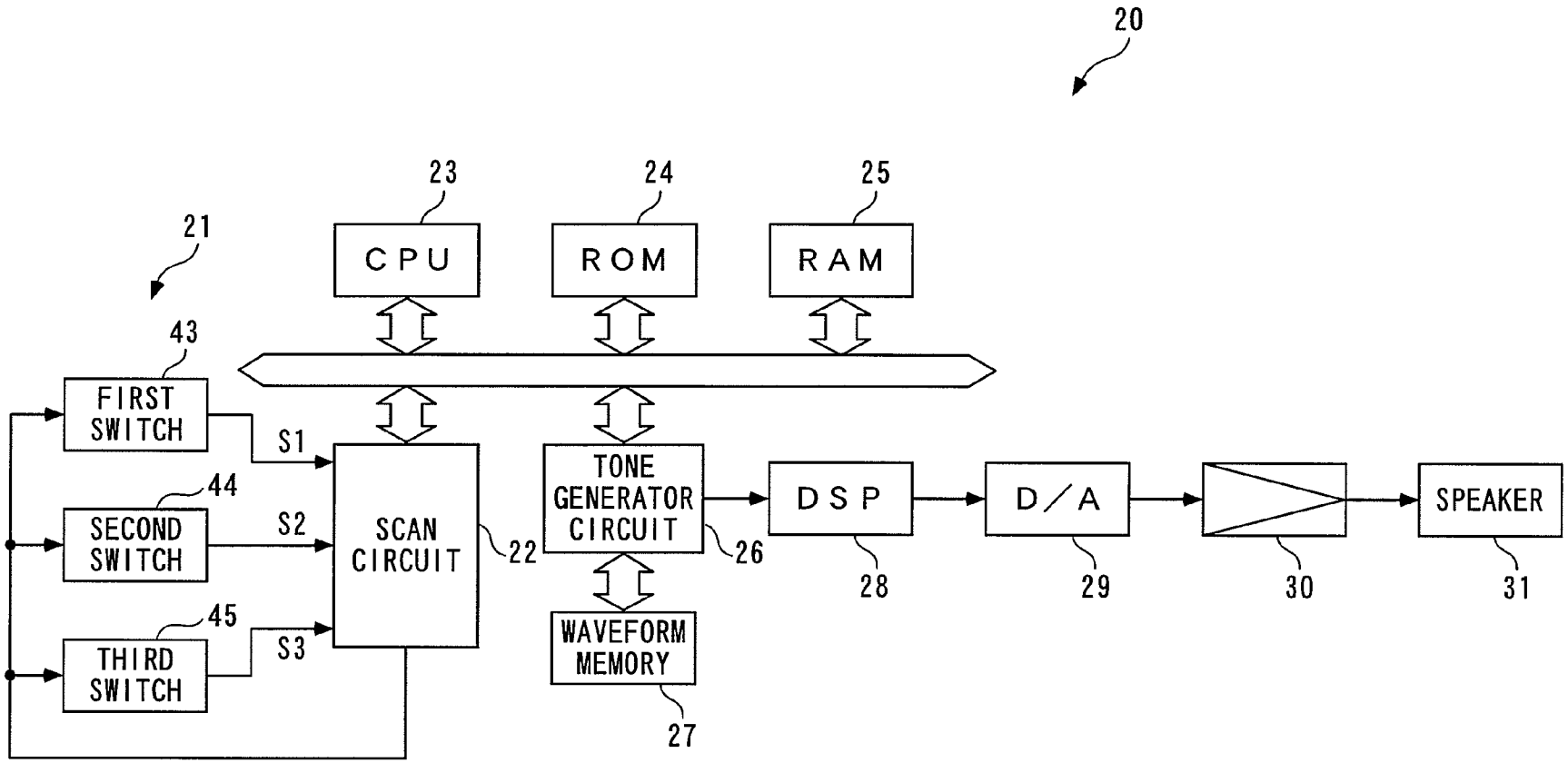

A flowchart of a sounding control process executed by a CPU appearing in FIG. 4.

[FIG. 9]

A flowchart of a subroutine for carrying out a touch detection process.

[FIG. 10]

A flowchart of a subroutine for carrying out a tone volume setting process.

[FIG. 11]

A diagram showing the relationship between ON/OFF timings of first to third switches with respect to the key depression depth of a key in a second embodiment of the present invention.

[FIG. 12]

A diagram showing the relationship between ON/OFF timings of first and second switches with respect to the key depression depth of a key in a conventional musical tone control system.

[FIG. 13]

A diagram showing the relationship between ON/OFF timings of first and second switches with respect to the key depression depth of a key in another conventional musical tone control system.

MODE FOR CARRYING OUT INVENTION

Figure 1:
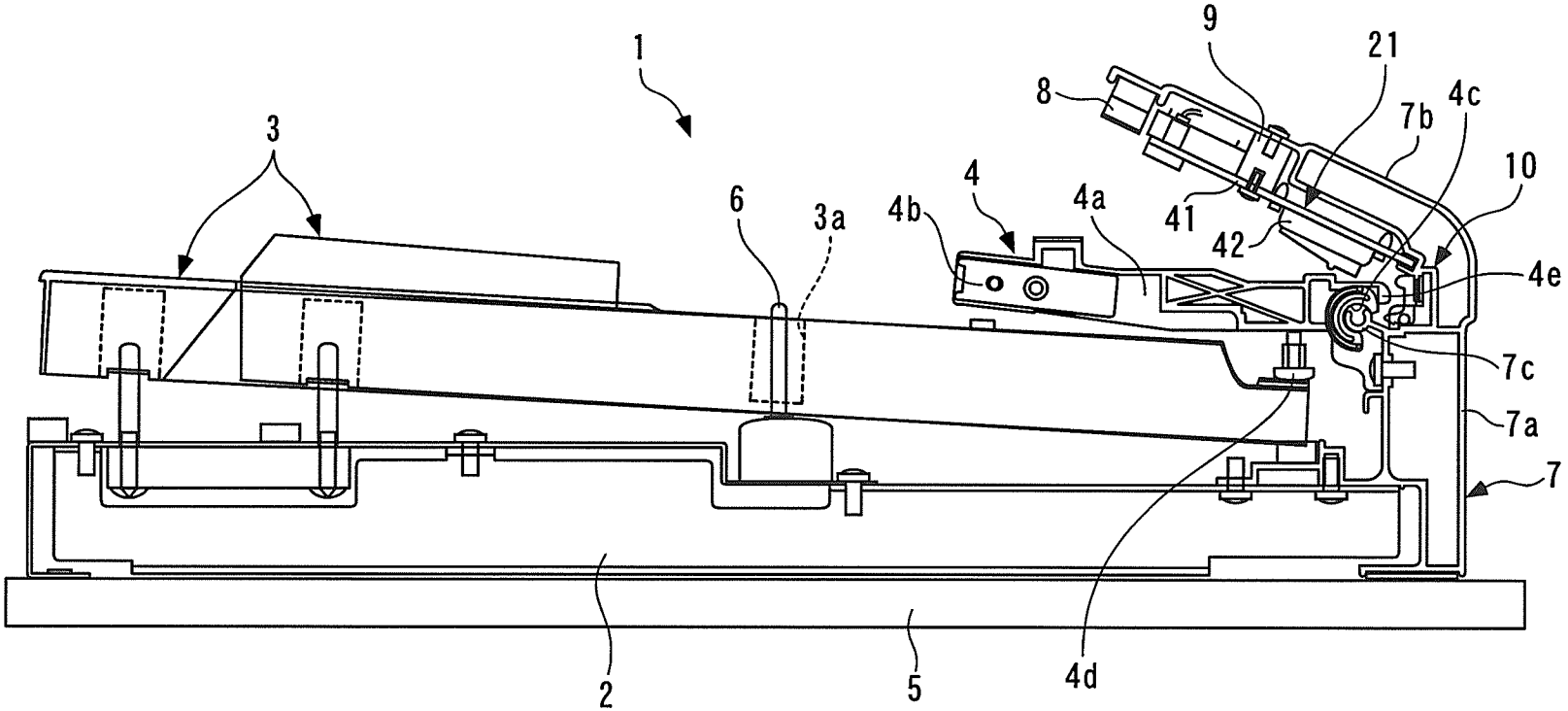
[FIG. 1]

The invention will now be described in detail with reference to the drawings showing preferred embodiments thereof. FIG. 1 is shows general construction of an electronic piano 1 according to an embodiment of the present invention. In the following description, a player's side (left side as viewed in FIG. 1) of the electronic piano 1 will be referred to as "front", and a remote side from the player's side (right side as viewed in FIG. 1) as "rear". Further, a player's left side and right side will be referred to as "left" and "right", respectively.

As shown in FIG. 1, the electronic piano 1 includes a chassis 2, a plurality of (e.g. eighty-eight) keys 3 (only one of white keys and one of black keys are shown in FIG. 1) mounted on the chassis 2 in a state arranged side by side in the left-right direction, a hammer rail 7, hammers 4 mounted on the hammer rail 7, a let-off mechanism 10 for imparting a let-off effect, and a musical tone control system 20 (see FIG. 4).

The chassis 2 is formed by assembling iron plates blanked and bent by a press and the like, and is screwed to a keybed 5. On a central part of the chassis 2 in the front-rear direction, a large number of balance pins 6 (only one of which is shown) are erected in a manner arranged side by side in the left-right direction.

The key 3 is pivotally supported by an associated one of the balance pins 6 via a balance pin hole 3*a* formed in the center of the key 3.

The hammer rail 7 is formed e.g. by one hollow extruded piece of aluminum such that it extends in the left-right direction, and is screwed to the chassis 2 and the keybed 5. The hammer rail 7 comprises a hammer supporting part 7*a* that extends vertically, a stopper-attaching part 7*b* that extends obliquely forward and upward from an upper end of the hammer supporting part 7*a*, and a fulcrum shaft portion 7*c* that extends obliquely forward and upward from a location close to a junction between the hammer supporting part 7*a* and the stopper-attaching part 7*b*. The stopper-attaching part 7*b* has a front end thereof provided with a stopper 8. The stopper 8 is formed of e.g. foamed urethane, and extends over the entire stopper-attaching part 7*b* in the left-right direction.

Each hammer 4 is provided for the associated one of the keys 3 and comprises a hammer body 4*a* which extends in the front-rear direction, and weight plates 4*b* (only one of which is shown) attached to respective opposite sides of the front portion of the hammer body 4*a*. The hammer body 4*a* has a rear end thereof formed with an shaft hole 4*c* which is arcuate in cross section and opens rearward. The shaft hole 4*c* is engaged with the fulcrum shaft portion 7*c* of the hammer rail 7, whereby the hammer 4 is pivotally supported on the hammer rail 7.

Further, the hammer body 4*a* has an adjustment screw 4*d* screwed therein from below at a location forward of the shaft hole 4*c* such that the adjustment screw 4*d* can be shifted forward and backward, and the hammer 4 is placed on a rearmost portion of the top of the associated key 3 via the adjustment screw 4*d*. Further, the hammer body 4*a* has a portion upward of the shaft hole 4*c* protruding rearward, and this protruding portion functions as an actuator portion 4*e* for driving the let-off mechanism 10.

Figure 2:
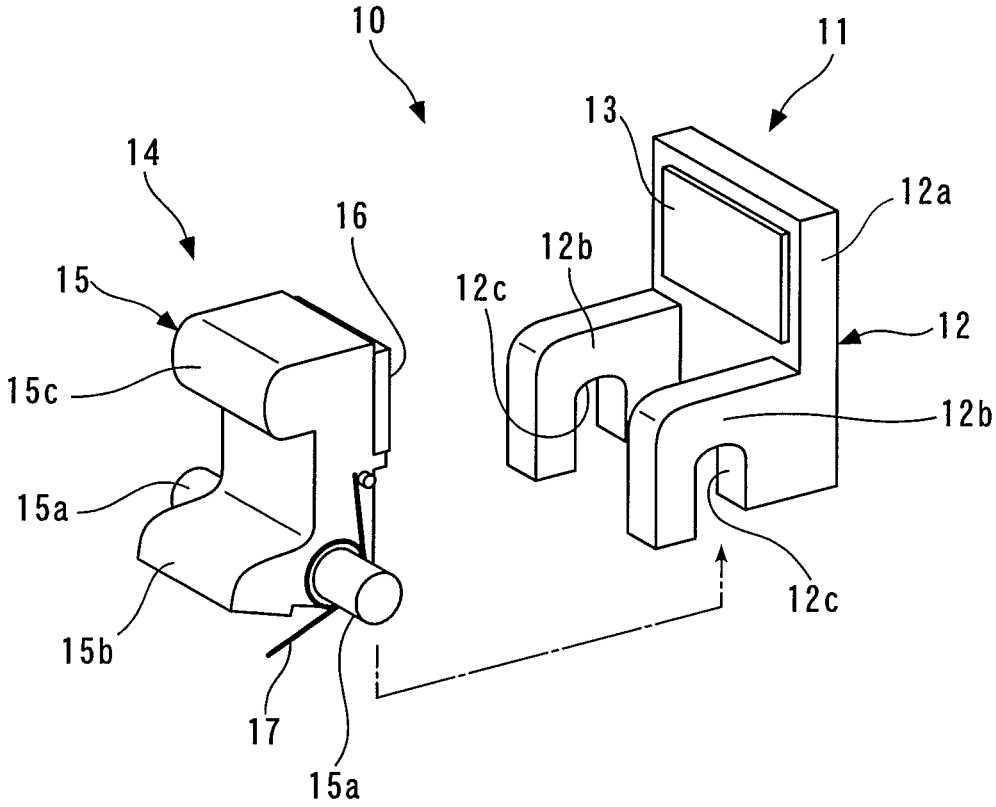
Figure 3:
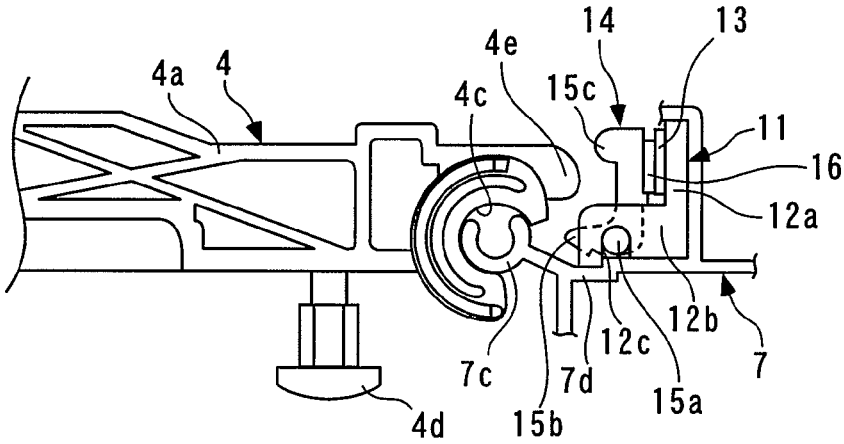
Figure 3:
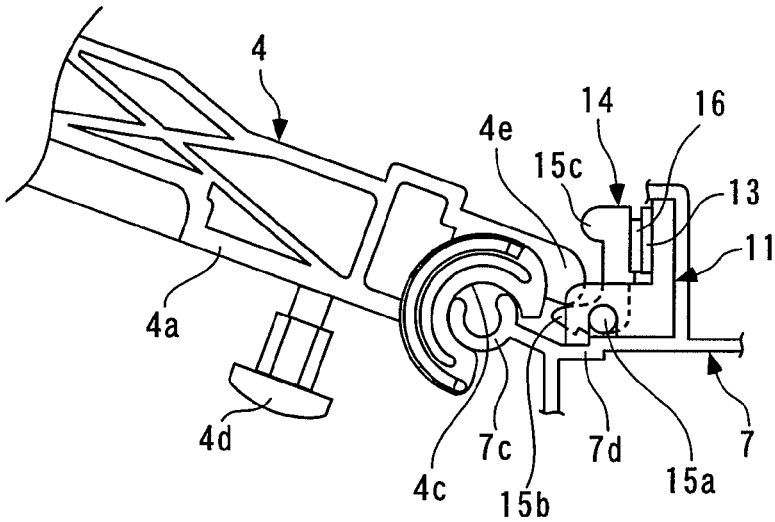
Figure 3:
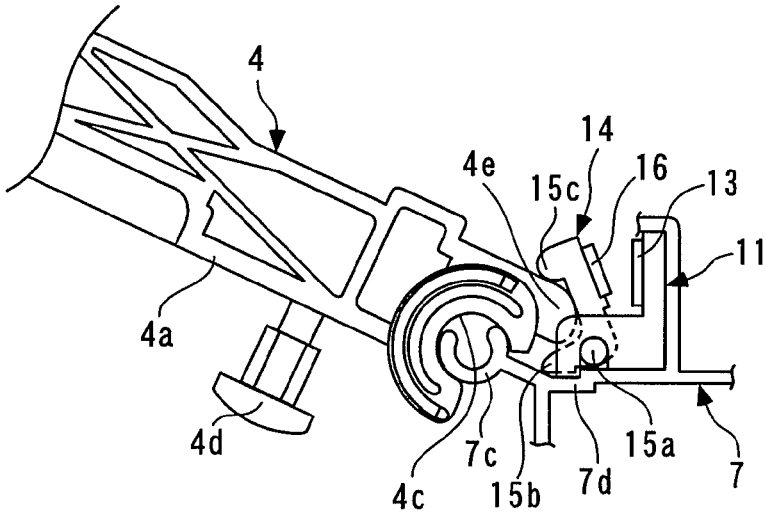

As shown in FIGS. 1 to 3, the let-off mechanism 10 is disposed immediately rearward of the actuator portion 4*e* of the hammer 4, and comprises a holder 11 and a jack 14 pivotally mounted to the holder 11.

The holder 11 comprises a holder body 12 and an attracting part 13 attached to the holder body 12. The holder body 12 is formed e.g. of a synthetic resin, and includes a rectangular rear wall portion 12*a* extending vertically and a pair of left and right jack support portions 12*b* and 12*b* protruding forward from a lower half of the rear wall portion 12*a*. The attracting part 13 is formed by a magnetic member, such as a metal plate, and is attached to an upper half of the front surface of the rear wall portion 12*a*. The left and right jack support portions 12*b* and 12*b* have respective downwardly open support holes 12*c* and 12*c* formed in a manner opposed to each other. Further, a portion, forward of the support hole 12*c*, of each of the jack support portions 12*b* protrudes downward to a level slightly lower than the bottom of the rear wall portion 12*a*, and this protruding portion is engaged with a stepped portion 7*d* formed in the hammer rail 7, whereby the holder 11 is screwed to the hammer rail 7 in a state placed on the hammer rail 7 and positioned on the same in the front-rear direction.

On the other hand, the jack 14 comprises a jack body 15 and an attracted part 16 attached to the jack body 15. The jack body 15 is formed e.g. of a synthetic resin. The jack body 15 has a pair of left and right pins 15*a* and 15*a* protruding leftward and rightward, respectively, from the bottom thereof, and the left and right pins 15*a* and 15*a* are engaged with the respective left and right support holes 12*c* and 12*c* of the holder 11, whereby the jack 14 is supported on the holder 11 in a state in which it is pivotally movable and prevented from falling off. Further, the jack body 15 has a lower end thereof formed with a pressure-receiving portion 15*b* which is pressed by the actuator portion 4*e* during pivotal motion of the hammer 4 and an upper end thereof formed with a hammer contact portion 15*c* with which the pivotally moved hammer 4 is brought into contact. The pressure-receiving portion 15*b* and the hammer contact portion 15*c* are both formed to protrude forward. The attracted part 16 is formed by a magnet and is attached to a rear surface of the jack body 15 in a manner opposed to the attracting part 13. A coil spring 17 for urging the jack 14 toward the holder 11 (in a clockwise direction as viewed in FIG. 2) is mounted to one of the pins 15*a* of the jack body 15.

Next, a description will be given of the operation of the electronic piano 1 constructed as above. As shown in FIGS. 1 and 3(*a*), in the key-released state of the key 3, the hammer 4 extends substantially horizontally, with the actuator portion 4*e* of the hammer 4 opposed to the jack 14 in a state spaced from the same. At this time, the attracted part 16 of the jack 14 is held attracted to the attracting part 13 of the holder 11, whereby the jack 14 is held by the holder 11.

When the key 3 is depressed in the key-released state, the hammer 4 is pushed upward via the adjustment screw 4*d* to pivotally move about the fulcrum shaft portion 7*c* in a counterclockwise direction as viewed in FIG. 3. Then, when the hammer 4 is pivotally moved by a predetermined stroke as shown in FIG. 3(*b*), the actuator portion 4*e* comes into engagement with the pressure-receiving portion 15*b* of the jack 14 to push the same downward. As a consequence, the attracted part 16 is released from the attracting part 13 of the holder 11 against the attraction force of the attracting part 13 and the urging force of the coil spring 17 as shown in FIG. 3(*c*), and the jack 14 pivotally moves in the counterclockwise direction as viewed in FIG. 3. The engagement of the actuator portion 4*e* with the jack 14 and the release of the jack 14 from the actuator portion 4*e* cause an increase in touch weight and then sharp reduction of the touch weight. Thus, a let-off effect closely analogous to the let-off of an acoustic piano is obtained.

Then, the hammer 4 further continues pivotal motion, and the hammer 4 abuts against the stopper 8, whereby a string striking effect analogous to the string striking effect of an acoustic piano can be obtained. In this state, as shown in FIG. 3(*c*), the pressure-receiving portion 15*b* of the jack 14 is in contact with the hammer rail 7, and the contact portion 15*c* is in contact with the hammer 4. As the hammer 4 performs pivotal motion returning in the counterclockwise direction as viewed in FIG. 3 after abutment on the stopper 8, the jack 14 pivotally moves in the clockwise direction as viewed in FIG. 3 while being pressed by the hammer 4 via the contact portion 15*c*, and the attracted part 16 is attracted to the attracting part 13, whereby the jack 14 returns to the key-released state. At this time, the urging force of the coil spring 17 acts to reliably return the jack 14 to the key-released state.

As shown in FIG. 4, the musical tone control system 20 comprises a key switch 21, a scan circuit 22, a CPU 23, a ROM 24, a RAM 25, a tone generator circuit 26, a waveform memory 27, a DSP 28, a D/A converter 29, a power amplifier 30, and a speaker 31.

Figure 5:
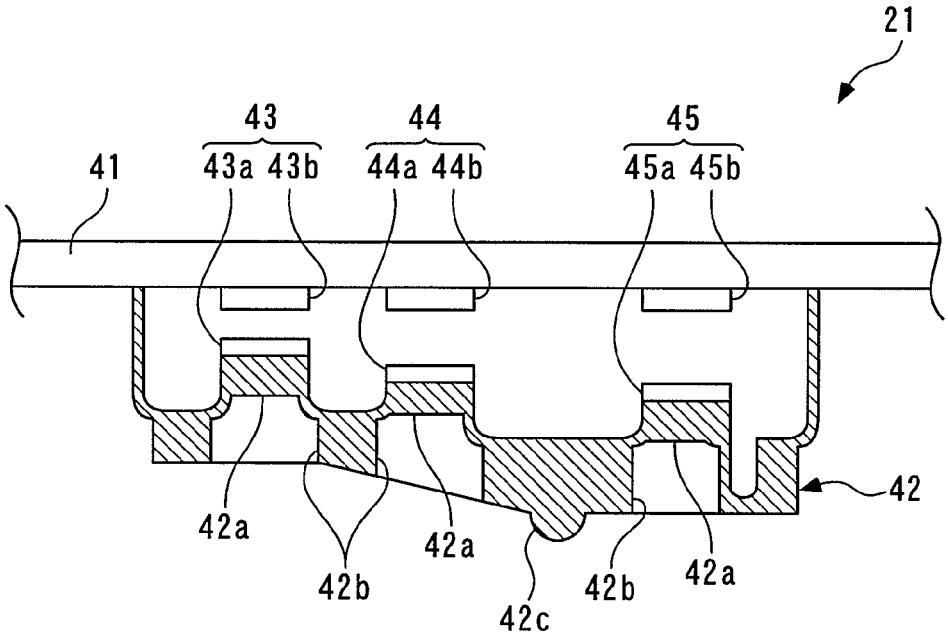

As shown in FIG. 5, the key switch 21 comprises a printed circuit board 41, a cover 42 attached to the lower surface of the printed circuit board 41, and a first switch 43, a second switch 44, and a third switch 45, which are disposed inside the cover 42.

The cover 42 is formed of an elastic material, such as rubber, and has a protuberance 42*c* protuberating downward from the lower surface thereof at a location slightly rearward of the center of the lower surface. A portion, forward of the protuberance 42*c*, of the lower surface of the cover 42 extends obliquely downward and rearward, and a portion, rearward of the protuberance 42*c*, of the lower surface of the cover 42 extends in parallel relation to the printed circuit board 41. Inside the cover 42, there are formed three extension parts 42*a*, 42*a*, and 42*a* each extending upward and arranged side by side in the front-rear direction. The distances between the extension parts 42*a* and the printed circuit board 41 are set such that the distance between the front-side (left as viewed in FIG. 5) extension part 42*a* and the printed circuit board 41 assumes a minimum value and that between the rear-side (right as viewed in FIG. 5) one and the printed circuit board 41 assumes a maximum value. Further, below each of the extension parts 42*a*, there is formed a recessed portion 42*b* open downward.

The first switch 43 comprises a contact point 43*a* and a circuit section 43*b*. The contact point 43*a* is formed by a conductor and attached to the upper surface of the front-side extension part 42*a*. The circuit section 43*b* is formed on the printed circuit board 41 in facing relation to the contact point 43*a*.

Similarly to the first switch 43, the second switch 44 comprises a contact point 44*a* and a circuit section 44*b*. The contact point 44*a* is attached to the upper surface of the central extension part 42*a*. The circuit section 44*b* is formed on the printed circuit board 41 in facing relation to the contact point 44*a*.

Similarly to the first and second switches 43 and 44, the third switch 45 comprises a contact point 45*a* formed by a conductor, and a circuit section 45*b*. The contact point 45*a* is attached to the upper surface of the rear-side extension part 42*a*. The circuit section 45*b* is formed on the printed circuit board 41 in facing relation to the contact point 45*a*.

As shown in FIG. 1, the key switch 21 constructed as above is screwed to the stopper-attaching part 7*b* of the hammer rail 7 via a spacer 9, with the printed circuit board 41 inserted into a base part of the stopper-attaching part 7*b*, and faces a base part of the hammer 4. In the key-released state shown in FIG. 1, the first to third switches 43 to 45 are all in an OFF state. As the hammer 4 pivotally moves from this state in accordance with depression of the key 3, the cover 42 is pressed via the protuberance 42*c*. The three extension parts 42*a* are arranged as described above, and hence in accordance with pressure by the hammer 4, first, the contact point 43*a* of the first switch 43 is brought into contact with the circuit section 43*b*, then the contact point 44*a* of the second switch 44 is brought into contact with the circuit section 44*b*, and further the contact point 45*a* of the third switch 45 is brought into contact with the circuit section 45*b*, whereby the first to third switches 43 to 45 are sequentially turned on. Further, first to third detection signals S1 to S3 indicative of the ON/OFF states of the respective first to third switches 43 to 45 are output to the scan circuit 22.

Figure 6:
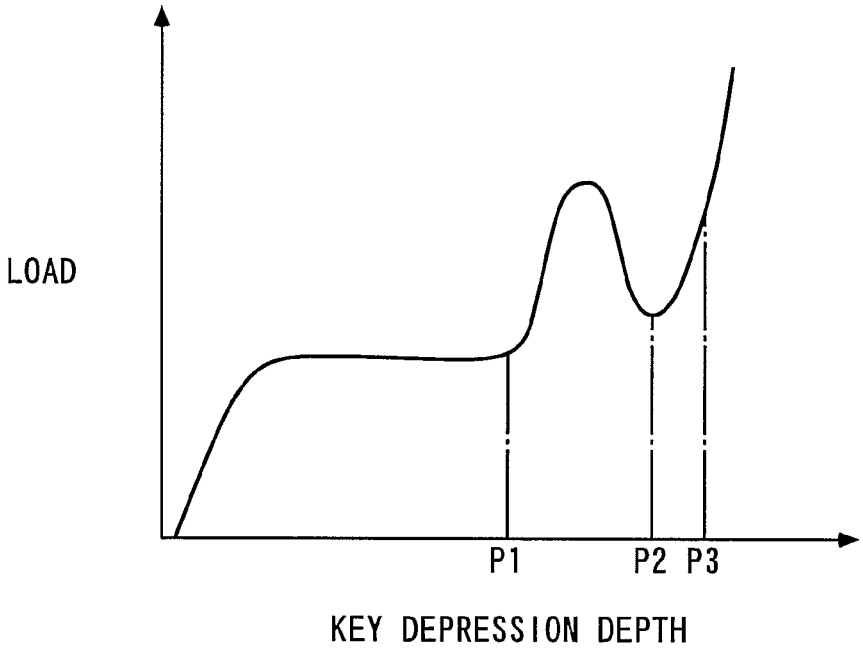
Figure 7:
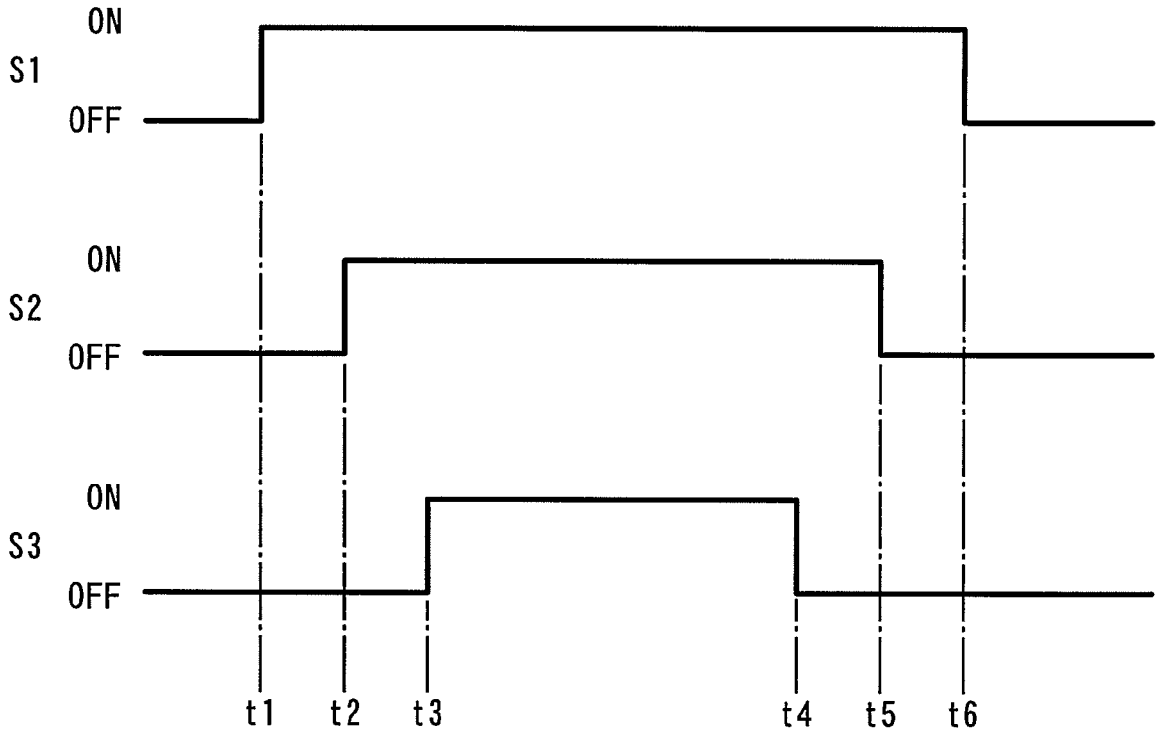

FIG. 6 shows the relationship between the ON/OFF timings of the first to third switches 43 to 45 with respect to the key depression depth of the key 3, and FIG. 7 is a timing diagram of the first to third detection signals S1 to S3 output in accordance with pivotal motion of the key 3. First, when the key 3 is in the key-released state, each of the first to third detection signals S1 to S3 is in an OFF state (before time t1 in FIG. 7). When the key 3 is depressed in the key-released state and reaches a first position P1 (see FIG. 6) corresponding to a key depression depth obtained immediately before the start of a let-off by the let-off mechanism 10, the first switch 43 is turned on, and the first detection signal S1 is switched from OFF to ON (t1). When the key 3 is further pivotally moved and reaches a second position P2 corresponding to a key depression depth obtained immediately after the termination of the let-off, the second switch 44 is turned on, and the second detection signal S2 is switched from OFF to ON (t2). Then, when the key 3 is further pivotally moved and reaches a third position P3 corresponding to a predetermined key depression depth obtained after the termination of the let-off, the third switch 45 is turned on, and the third detection signal S3 is switched from OFF to ON (t3). The third position P3 corresponds to a key depression depth obtained immediately before abutment of the hammer 4 against the stopper 8.

Then, when the key 3 pivotally returns to the third position P3, the third switch 45 is turned off, and the third detection signal S3 is switched from ON to OFF (t4). When the key 3 further pivotally returns to the second position P2, the second switch 44 is turned off, and the second detection signal S2 is switched from ON to OFF (t5). When the key 3 further pivotally returns to the first position P1, the first switch 43 is turned off, and the first detection signal S1 is switched from ON to OFF (t6). Thereafter, the key 3 returns to its key-released position.

The scan circuit 22 detects ON/OFF information on each key 3 and key number information for identifying a key 3 turned on or off, based on the first to third detection signals S1 to S3 output from the respective first to third switches 43 to 45, and outputs the ON/OFF information and the key number information as key depression information data on each key 3 to the CPU 23 together with the first to third detection signals S1 to S3.

The ROM 24 stores not only control programs to be executed by the CPU 23, but also fixed data for controlling tone volume and so forth. The RAM 25 not only temporarily stores status information indicative of an operational status of the electronic piano 1, but also is used as a work area for the CPU 23.

The tone generator circuit 26 reads out sound source waveform data and envelope data from the waveform memory 27 according to a control signal from the CPU 23, and adds the envelope data to the read-out source waveform data to thereby generate a musical tone signal as an original tone. The DSP 28 imparts a predetermined acoustic effect to the musical tone signal generated by the tone generator circuit 26. The D/A converter 29 converts the musical tone signal having the acoustic effect imparted by the DSP 28, as a digital signal, to an analog signal. The power amplifier 30 amplifies the analog signal obtained through the conversion, by a predetermined gain, and the speaker 31 reproduces the amplified analog signal and outputs the reproduced analog signal as a musical tone.

The CPU 23 executes a sounding control process including processes for setting sounding timing and sounding stop timing as well as setting tone volume, according to the first to third detection signals S1 to S3 from the first to third switches 43 to 45. Note that in the present embodiment, the CPU 23 corresponds to key depression velocity-calculating means, tone volume-setting means, sounding timing-setting means, sounding stop timing-setting means, and key depression velocity-correcting means.

Figure 8:
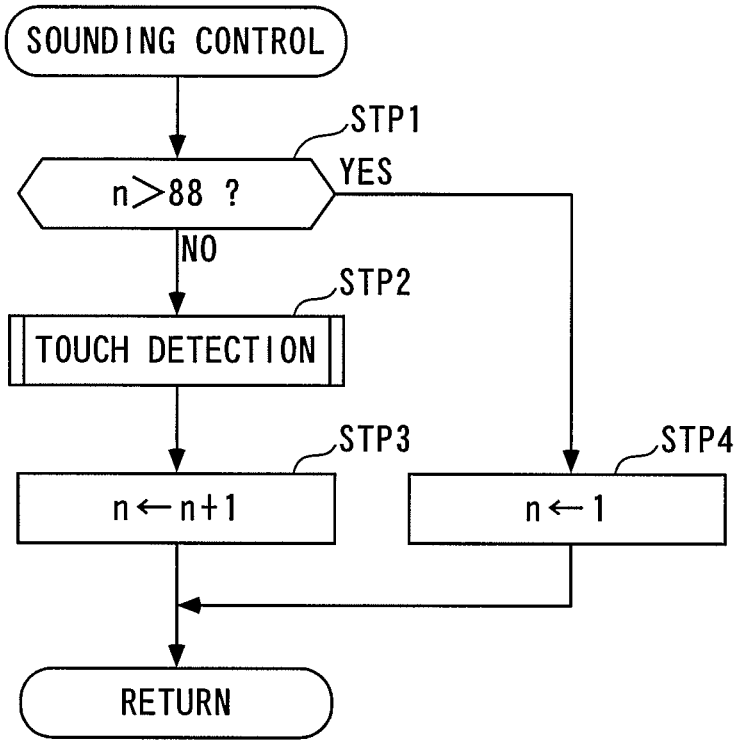

FIG. 8 is a flowchart of the sounding control process executed by the CPU 23. The present process is executed sequentially for all the eighty-eight keys 3. In the present process, first, in a step 1 (shown as STP1 in abbreviated form in FIG. 8; the following steps are also shown in abbreviated form), it is determined whether or not the value of a key number n (n=1 to 88) indicative of a key 3 is larger than a value of 88. The key numbers n are serial numbers assigned to the respective keys arranged in order from the lowest-pitch tone to the highest-pitch tone. The key number "1" is assigned to the lowest-pitch key 3, and the key number "88" to the highest-pitch key 3.

If the answer to the question is negative (NO), a touch detection process including detection of sounding timing and sounding stop timing associated with the present key number n is executed (step 2). Then, the key number n is incremented (step 3), followed by terminating the sounding control process.

On the other hand, if the answer to the question of the step 1 is affirmative (YES), it is determined that the touch detection process has been completely executed for all the eighty-eight keys, and the key number n is initialized to a value of 1 (step 4), followed by terminating the sounding control process.

Figure 9:
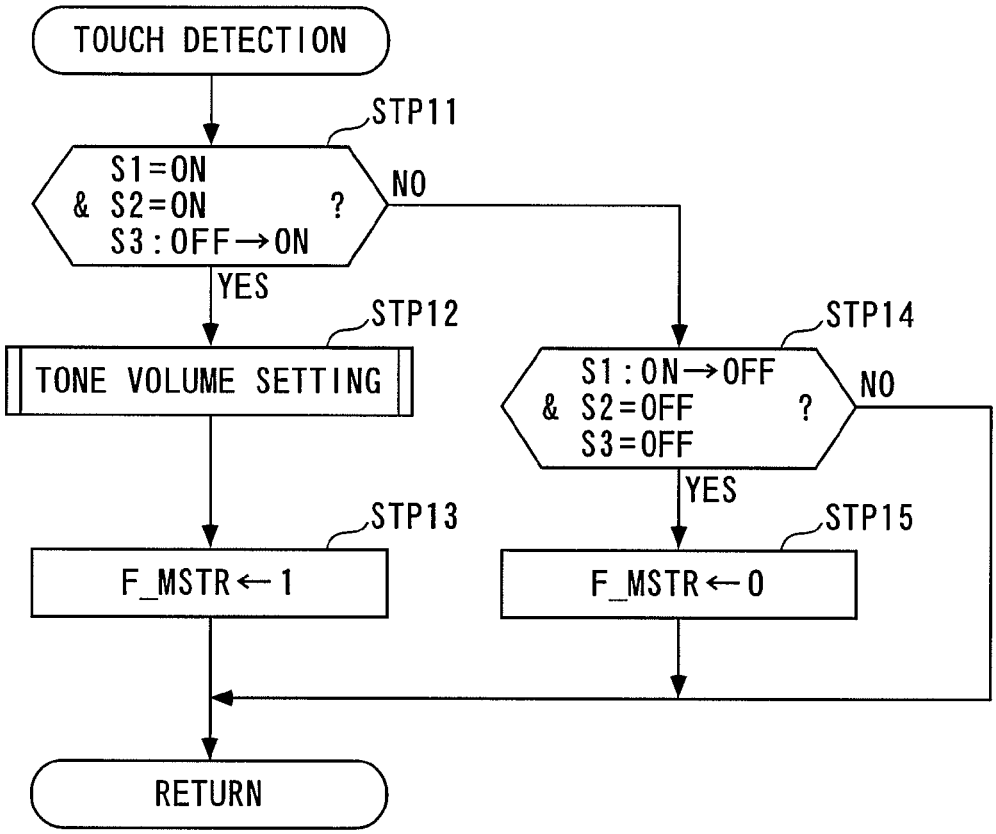

The touch detection process is executed according to a subroutine shown in FIG. 9. In the present process, first, it is determined in a step 11 whether or not the first and second detection signals S1 and S2 from the first and second switches 43 and 44 are both ON and at the same time whether or not the third detection signal S3 from the third switch 45 has been switched from OFF to ON between the immediately preceding loop and the present loop. If the answer to the question is affirmative (YES), i.e. if the hammer 4 has reached the third position P3 (see FIG. 6) after the termination of the let-off of the key 3 and immediately before abutment of the hammer 4 against the stopper 8, it is determined that it is time to sound an associated musical tone, and the tone volume of the musical tone to be sounded is set (step 12).

Figure 10:
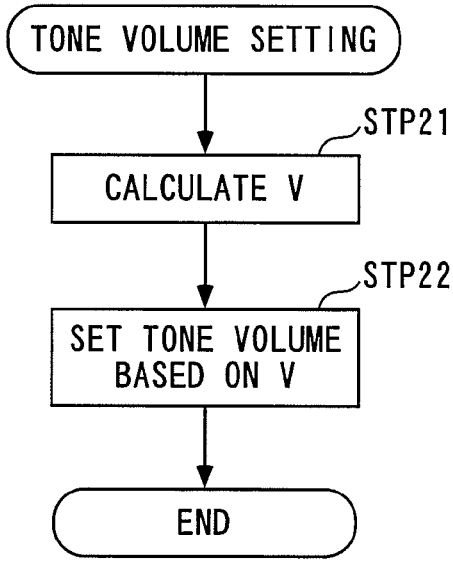

The tone volume setting process is executed according to a subroutine shown in FIG. 10. In the present process, first, a velocity V as the key depression velocity of the key 3 is calculated in a step 21. Specifically, a time period from a time point when the second detection signal S2 is switched from OFF to ON to a time point when the third detection signal S3 is switched from OFF to ON, i.e. a time period from a time point when the key depression depth of the key 3 reaches the second position P2 to a time point when the key depression depth reaches the third position P3 is calculated. Next, the velocity V is obtained by dividing a distance between the second position P2 and the third position P3 by the calculated time period. Then, the tone volume is set based on the calculated velocity V (step 22), followed by terminating the tone volume setting process.

Referring again to FIG. 9, in a step 13 following the step 12, a sounding flag $F_{13}$ STR is set to "1", followed by terminating the touch detection process. When the sounding flag $F_{13}$ STR is set to "1", a control signal for starting sounding is output to the tone generator circuit 26, whereby musical tone sounding based on the determined tone volume is started.

On the other hand, if the answer to the question of the step 11 is negative (NO), it is determined whether or not the first detection signal S1 has been switched from ON to OFF between the present loop and the immediately preceding loop and at the same time whether or not the second and third detection signals S2 and S3 are both OFF (step 14). If the answer to the question of the step 14 is negative (NO), the present process is terminated.

On the other hand, if the answer to the question of the step 14 is affirmative (YES), i.e. if the key 3 has pivotally returned to the first position P1, it is judged that it is time to stop sounding of the musical tone, and the sounding flag $F_{13}$ STR is reset to "0" (step 15), followed by terminating the present process. Thus, a control signal for stopping sounding of the musical tone is output to the tone generator circuit 26, whereby musical tone sounding is stopped.

As described above, according to the present embodiment, a key depression information item associated with the first position P1 corresponding to a key depression depth obtained immediately before the start of a let-off by the let-off mechanism 10 is detected by the first switch 43, a key depression information item associated with the second position P2 corresponding to a key depression depth obtained immediately after the termination of the let-off is detected by the second switch 44, and a key depression information item associated with the third position P3 corresponding to a key depression depth obtained after the termination of the let-off is detected by the third switch 45. The velocity V is calculated based on the second and third detection signals S2 and S3, between which the let-off does not occur, of the first to third detection signals S1 to S3 from the first to third switches 43 to 45, so that it is possible to calculate the velocity V with high accuracy without being much affected by the rotational resistance of the key 3. Further, the tone volume of a musical tone is set using the thus calculated velocity V, and hence it is possible to obtain the tone volume in a manner suited to a key depressing force.

Furthermore, sounding timing is set based on the third detection signal S3, so that a musical tone can be sounded in appropriate timing closest to string striking timing as in an acoustic piano. What is more, sounding stop timing is set based on the first detection signal S1, which makes it possible to stop musical tone sounding in appropriate timing close to key release timing.

Figure 11:
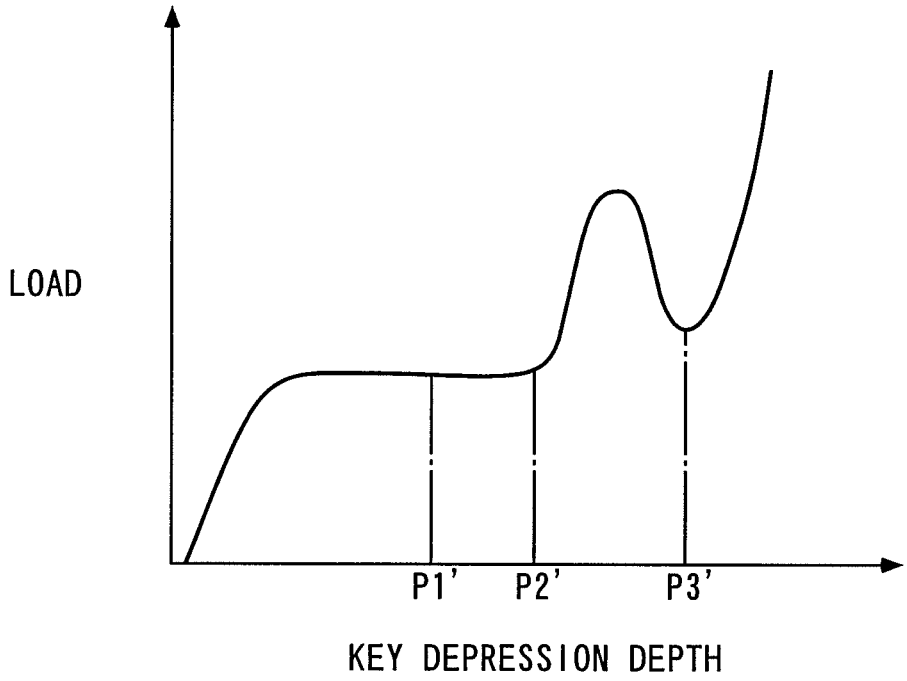
Figure 12:
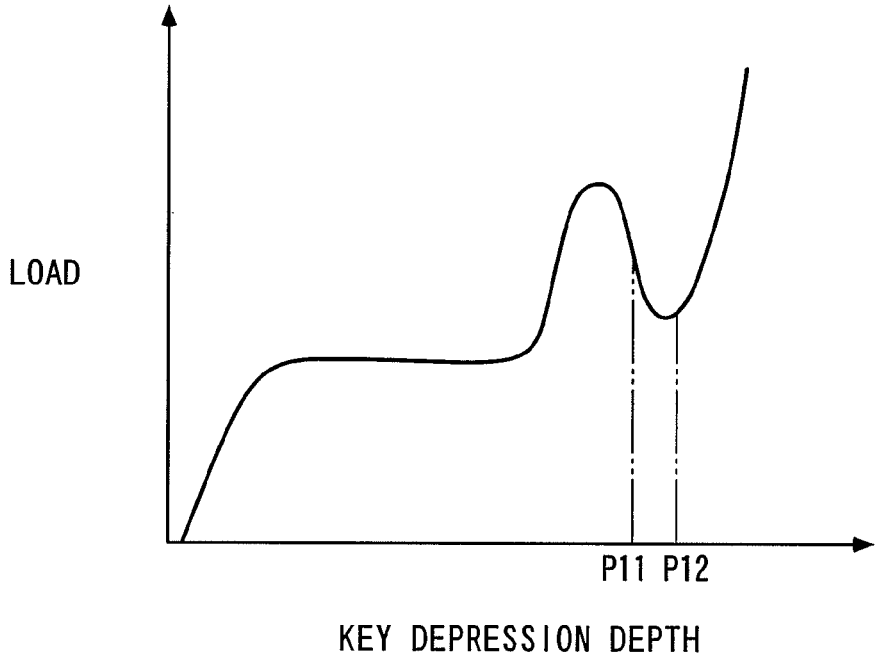
Figure 13:
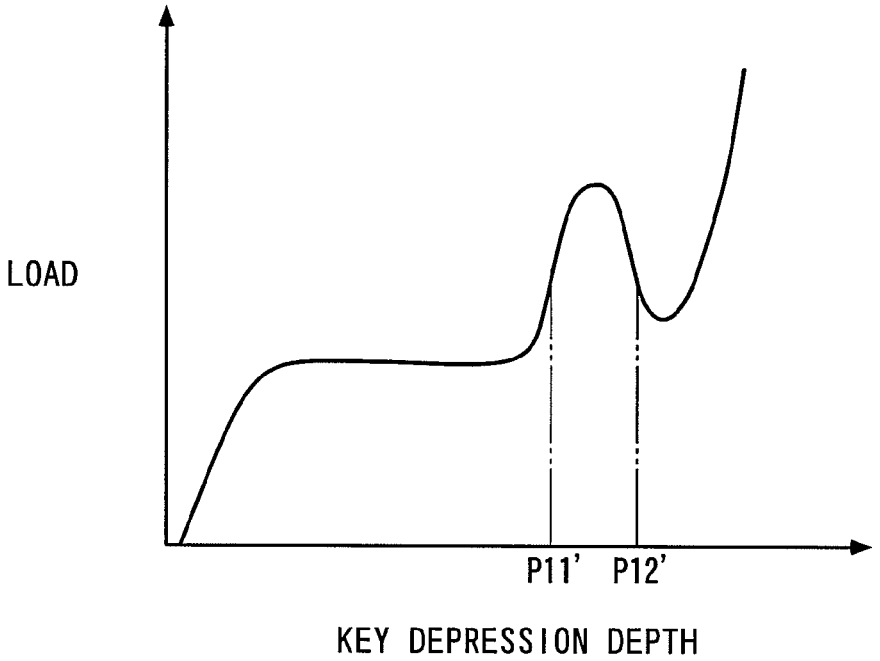

FIG. 11 shows the relationship between the ON/OFF timings of the first to third switches 43 to 45 with respect to the key depression depth of a key 3 in a second embodiment of the present invention. In the second embodiment, a key depression information item associated with a first position P1' is detected by the first switch 43, a key depression information item associated with a second position P2' is detected by the second switch 44, and a key depression information item associated with a third position P3' is detected by the third switch 45. As shown in FIG. 11, the first position P1' corresponds to a depth of depression of the key 3 before the start of a let-off, and the second position P2' corresponds to a key depression depth which is obtained immediately before the start of the let-off and is larger than that corresponding to the first position P1'. Further, the third position P3' corresponds to a key depression depth obtained immediately after the termination of the let-off. The relationship between the ON/OFF timings of the first to third switches 43 to 45 with respect to the key depression depth can be realized e.g. by setting the lengths of the respective extension parts 42*a* of the cover 42 to be larger than those set in the first embodiment and reducing the distance between each of the contact points 43*a* to 45*a* and the associated one of the circuit sections 43*b* to 45*b*.

Further, in the second embodiment, the velocity V is calculated using the first to third detection signals S1 to S3 from the first to third switches 43 to 45, based on the following equation (1):

$$V = V1 \times K + V2 \times (1 - K) \quad (1)$$

In the equation (1), V1 represents a first velocity V1 which is a key depression velocity at which the key 3 is depressed during a time period from a time point when the depth of depression of the key 3 reaches the first position P1' to a time point when the depth of depression of the key 3 reaches the second position P2'. Further, V2 represents a second velocity V2 which is a key depression velocity at which the key 3 is depressed during a time period from a time point when the depth of depression of the key 3 reaches the second position P2' to a time point when the depth of depression of the key 3 reaches the third position P3'. The first and second velocities V1 and V2 are calculated by the same method as used to calculate the velocity V in the first embodiment. Furthermore, K represents a weighting coefficient which is larger than 0 and smaller than 1.0.

Then, the tone volume of the musical tone is set based on the calculated velocity V. Further, sounding timing is set based on the third detection signal S3, and sounding stop timing is set based on the first detection signal S1.

As described above, according to the second embodiment, the velocity V is calculated using the first and second detection signals S1 and S2, between which the let-off does not occur, so that it is possible to calculate the velocity V with high accuracy without being adversely affected by the rotational resistance of the key 3, similarly to the first embodiment, and appropriately determine the tone volume of a musical tone based on the calculated velocity V. Further, the velocity V is calculated by correcting the first velocity V1 as a key depression velocity at which the key 3 is pressed before the start of a let-off, using the second velocity V2, so that even when depression of a key 3 is stopped immediately before the start of the let-off and then resumed, it is possible to obtain a velocity V and a musical tone volume matching the playing method.

Furthermore, since sounding timing is set based on the third detection signal S3, it is possible to sound a musical tone in appropriate timing, similarly to the first embodiment. What is more, sounding stop timing is set based on the first detection signal S1, which makes it possible to stop musical tone sounding in appropriate timing closest to key release timing.

Note that the present invention is by no means limited to the embodiments described above, but it can be practiced in various forms. For example, although in the first embodiment, the first position P1 is set to a position corresponding to a key depression depth obtained immediately before the start of a let-off, this is not limitative, but the first position P1 may be set to any position corresponding to a key depression depth obtained before the start of the let-off. Further, although in the first embodiment, the second position P2 is set to a position corresponding to a key depression depth obtained immediately after the termination of the let-off, this is not limitative, but the second position P2 may be set to any position corresponding to a key depression depth obtained around the termination of a let-off, i.e. any position between a position immediately before the termination of the let-off and the third position P3.

Further, although in the second embodiment, the third position P3' is set to a position corresponding to a key depression depth obtained immediately after the termination of the let-off, this is not limitative, but the third position P3' may be set to any position corresponding to a key depression depth obtained after the termination of the let-off. Further, although in the second embodiment, the second position P2' is set to a position corresponding to a key depression depth obtained immediately before the start of the let-off, this is not limitative, but the second position P2' may be set to any position corresponding to a key depression depth obtained around the start of a let-off, i.e. any position between the first position P1' and a position immediately after start of the let-off.

Furthermore, although in the second embodiment, the second velocity V2 is detected using the second and third detection signals S2 and S3, this is not limitative, but the second velocity V2 may be calculated using the first and third detection signals S1 and S3 and be used to correct the first velocity V1.

What is more, although in the second embodiment, the weighting coefficient K is used in the case of correcting the first velocity V1 based on the second velocity V2, this is not limitative, but any other suitable method may be employed.

The let-off mechanism 10 used in the present embodiments is only an example, and therefore a let-off mechanism having another construction may be employed insofar as it can impart the let-off effect. Further, although in the above-described embodiments, the first to third switches 43 to 45 are operated by the hammer 4, this is not limitative, but the switches may be provided e.g. on a chassis and be operated by a key.

Further, although in the above-described embodiments, switches are used as key depression information-detecting means, any other device, such as an optical sensor, may be employed insofar as the ON/OFF state thereof can be detected. It is to be further understood that various changes and modifications may be made without departing from the spirit and scope thereof.

INDUSTRIAL APPLICABILITY

As described above, the musical tone control system for an electronic keyboard instrument, according to the present invention, is capable of calculating a key depression velocity with high accuracy without being adversely affected by a large rotational resistance of a key, and is useful for stopping sounding of a musical tone in appropriate timing.

REFERENCE SIGNS LIST

1 electronic piano (electronic keyboard instrument)
3 key
10 let-off mechanism
20 musical tone control system
23 CPU (key depression velocity-calculating means, tone volume-setting means, sounding timing-setting means, sounding stop timing-setting means, and key depression velocity-correcting means)
43 first switch (first key depression information-detecting means)
44 second switch (second key depression information-detecting means)
45 third switch (third key depression information-detecting means)
P1 first position
P2 second position
P3 third position
P1' first position
P2' second position
P3' third position
S1 first detection signal (first key depression information item)
S2 second detection signal (second key depression information item)
S3 third detection signal (third key depression information item)
V velocity (key depression velocity)
V1 first velocity (key depression velocity calculated based on the first and second key depression information items)

The invention claimed is:

1. A musical tone control system for an electronic keyboard instrument having a let-off mechanism for imparting a let-off effect in accordance with depression of a key, comprising:

first key depression information-detecting means for detecting key depression information on the key at a first position corresponding to a key depression depth obtained before start of a let-off by the let-off mechanism, as a first key depression information item;

second key depression information-detecting means for detecting key depression information on the key at a second position corresponding to a larger key depression depth than the first position key depression depth, which is obtained around start of the let-off as a second key depression information item;

third key depression information-detecting means for detecting key depression information on the key at a third position corresponding to a larger key depression depth than the second position key depression depth, which is obtained after the termination of the let-off as a third key depression information item;

key depression velocity-calculating means for calculating a key depression velocity of the key, based on the detected first and second key depression information items;

tone volume-setting means for setting tone volume of a musical tone, based on the calculated key depression velocity of the key, sounding timing-setting means for setting sounding timing for sounding the musical tone based on the third key depression information item; and sounding stop timing-setting means for setting sounding stop timing for stopping sounding of the musical tone, based on the first or second key depression information item, wherein said key depression velocity-calculating means includes key depression velocity-correcting means for correcting the key depression velocity calculated based on the first and second key depression information items, according to the first and third key depression information items or the second and third key depression information items.

* * * * *